US008939718B2

(12) United States Patent
Claus et al.

(10) Patent No.: US 8,939,718 B2
(45) Date of Patent: Jan. 27, 2015

(54) TURBOCHARGER HAVING AN INSERTION PLATE

(75) Inventors: Hartmut Claus, Grünstadt (DE); Holger Fäth, Fußgönheim (DE); Andre Kaufmann, Baienfurt (DE); Stefan Krauß, Grünstadt (DE)

(73) Assignee: Continental Automotive GmbH, Hannover (DE)

( * ) Notice: Subject to any disclaimer, the term of this patent is extended or adjusted under 35 U.S.C. 154(b) by 923 days.

(21) Appl. No.: 13/057,829

(22) PCT Filed: Jul. 3, 2009

(86) PCT No.: PCT/EP2009/058399

§ 371 (c)(1),
(2), (4) Date: Apr. 6, 2011

(87) PCT Pub. No.: WO2010/015466

PCT Pub. Date: Feb. 11, 2010

(65) Prior Publication Data

US 2011/0189011 A1 Aug. 4, 2011

(30) Foreign Application Priority Data

Aug. 6, 2008 (DE) ..... 10 2008 036 633

(51) Int. Cl.
*F04D 29/44* (2006.01)

(52) U.S. Cl.
CPC ..... *F04D 29/444* (2013.01)
USPC ..... 415/189; 415/186; 415/206; 415/208.2; 415/213.1

(58) Field of Classification Search
USPC ..... 415/184, 185, 186, 189, 203, 204, 206, 415/208, 211.2, 213.1, 227, 208.1, 208.2, 415/208.3
See application file for complete search history.

(56) References Cited

U.S. PATENT DOCUMENTS

| | | | | |
|---|---|---|---|---|
| 1,047,663 | A * | 12/1912 | Lawaczeck | 415/208.3 |
| 2,916,198 | A | 12/1959 | Weisel | |
| 3,276,204 | A | 10/1966 | Kellett | |
| 3,489,340 | A | 1/1970 | Holzhausen | |
| 4,354,802 | A * | 10/1982 | Nishida et al. | 415/207 |
| 4,395,197 | A * | 7/1983 | Yoshinaga et al. | 415/208.3 |
| 4,421,457 | A * | 12/1983 | Yoshinaga et al. | 415/208.3 |

(Continued)

FOREIGN PATENT DOCUMENTS

| | | |
|---|---|---|
| DE | 19713415 A1 | 11/1997 |
| FR | 2529966 A1 | 1/1984 |

(Continued)

OTHER PUBLICATIONS

Machine translation of FR 2529966A from EPO.*

(Continued)

*Primary Examiner* — Edward Look
*Assistant Examiner* — Christopher R Legendre
(74) *Attorney, Agent, or Firm* — Laurence A. Greenberg; Werner H. Stemer; Ralph E. Locher

(57) ABSTRACT

A turbocharger has a rotor housing. Said rotor housing has an insertion element. Said insertion element is configured such that the same forms an over-hanging spiral together with said rotor housing.

12 Claims, 5 Drawing Sheets

(56) References Cited

U.S. PATENT DOCUMENTS

| | | | | | |
|---|---|---|---|---|---|
| RE32,462 | E | * | 7/1987 | Yoshinaga et al. | 415/208.3 |
| 4,770,605 | A | * | 9/1988 | Nakatomi | 415/148 |
| 4,843,813 | A | * | 7/1989 | Paul | 60/39.162 |
| 5,516,263 | A | * | 5/1996 | Nishida et al. | 415/208.2 |
| 5,709,531 | A | | 1/1998 | Nishida et al. | |
| 5,988,976 | A | | 11/1999 | Mayleben | |
| 6,280,139 | B1 | * | 8/2001 | Romani et al. | 415/207 |
| 6,726,391 | B1 | * | 4/2004 | Kreis et al. | 403/28 |
| 8,240,984 | B2 | * | 8/2012 | Noelle | 415/164 |
| 2007/0036646 | A1 | | 2/2007 | Nguyen et al. | |
| 2009/0155058 | A1 | | 6/2009 | Noelle | |
| 2011/0189011 | A1 | * | 8/2011 | Claus et al. | 415/213.1 |

FOREIGN PATENT DOCUMENTS

| | | | | |
|---|---|---|---|---|
| JP | 11082389 | A | * | 3/1999 |
| WO | 2007018529 | A1 | | 2/2007 |

OTHER PUBLICATIONS

Machine translation of FR 2529966 A (Jan. 13, 1984) from EPO.*

* cited by examiner

PRIOR ART

TURBOCHARGER HAVING AN INSERTION PLATE

BACKGROUND OF THE INVENTION

Field of the Invention:

The invention relates to a turbocharger having an insertion plate on the compressor casing.

In general, a turbocharger has an exhaust gas turbine which is arranged in an exhaust gas flow and is connected by way of a shaft with a compressor in the intake tract. During operation, the exhaust gas flow is directed into the turbine where it drives the latter's turbine wheel. The turbine wheel in turn drives the compressor wheel, by means of which the compressor increases the pressure in the intake tract of the engine. During the induction cycle, a greater quantity of air therefore enters the cylinder. The result of this is that more oxygen is available and a correspondingly greater quantity of fuel can be combusted. This means that the power output of the engine can be increased.

In the case of turbochargers having a radial compressor, the air is first accelerated through the compressor rotor and kinetic energy is added to the gas. In a following radial diffuser, tangential and radial speed components are delayed and the required static pressure is thus built up. The characteristic external diameter of such a radial diffuser is normally 1.5 to 1.7 times that of the radial opening diameter. Connected to the diffuser is a so-called spiral which accepts the compressed gas and delivers it to the engine. In this situation, the compression ratio of the radial compressor depends in a first approximation on its rotational speed. With different engine mass flows and compressor circumferential speeds, a compressor wheel exit angle of the flow in a range from 30° to 80° results. Depending on the design of the spiral, in other words of the surfaces with respect to the radius ratio, a minimum total pressure loss of the spiral results at an exit angle of 45° to 80°.

With regard to the construction of a spiral, a compromise often needs to be found between the installation space available in the engine compartment and the optimum geometry in terms of flow engineering. In general this results in so-called overhanging spirals. Overhanging spirals are characterized by a radius of the centroid of the cross sectional area, which is similar to the diffuser exit radius.

Overhanging spirals can only be manufactured in a casting process using a core. A die-casting process is rejected here on account of the tooling. In order to obtain the required diffuser exit radius for the pressure recovery it is therefore necessary to provide a large installation space for die-cast spirals or to accept a lower pressure recovery. Furthermore, die-cast spirals are characterized by a lower degree of efficiency. On the other hand, die-cast spirals offer a clear cost advantage compared with the permanent mold casting process for example.

BRIEF SUMMARY OF THE INVENTION

Accordingly the object of the present invention is to make available a turbocharger having a compressor casing which for example also permits production by means of a cost-effective die-casting method.

This object is achieved by a turbocharger having the features as claimed.

Accordingly, a turbocharger is made available according to the invention having a rotor housing:

whereby the rotor housing (14) has an insertion element (24), whereby the insertion element (24) is implemented in such a manner that it forms an overhanging spiral with the rotor housing (14).

The turbocharger has the advantage that because of this for example a compressor casing does not have to be manufactured with an overhanging spiral using the sand-casting process.

Instead, a compressor casing can also be manufactured using the die-casting process, whereby an overhanging spiral can nevertheless be implemented by means of the insertion element.

Advantageous embodiments and developments of the invention are set down in the subclaims and in the description with reference to the drawings.

According to an embodiment of the invention, the rotor housing is a compressor casing. In this situation, the compressor casing has at least one spiral, whereby the insertion element directs or deflects an air-mass flow from a compressor wheel into the spiral of the compressor casing. This has the advantage that it is possible to counteract flow losses in the case of unfavorable flow angles and a high degree of efficiency can be achieved.

In a further embodiment according to the invention, the insertion element can be slid or arranged with its opening onto a shoulder or projection of the compressor casing. The opening of the insertion element can optionally additionally have a recess which engages in a corresponding projection of the shoulder of the compressor casing in order to additionally fix the insertion element in the radial direction. The insertion element has the advantage that it is simple to secure.

According to another embodiment of the invention, one, several or all blade elements of the insertion element can be spaced away from a wall situated opposite (diffuser rear wall for example), in other words not be supported on the latter. In the case where for example none of the blade elements is supported on the rotor housing, at least one support portion can be provided. This support portion can be formed by a projection having any desired contour, which like the blades for example is simply bent over forwards in order for example to be supported on the diffuser rear wall. In this situation, the support portion does not however need to form a blade shape but can be implemented in any desired manner provided that it permits the insertion element to be supported on the rotor housing, for example a diffuser rear wall of a compressor casing. Alternatively, one, several or all blade elements of the insertion element can also be implemented in such a manner that they can be additionally supported on the opposite wall, for example the diffuser rear wall. This has the advantage that any additional fixing of the insertion element can be dispensed with. In principle, the insertion element can however also otherwise additionally be secured by means of welding, brazing, screwing and/or mortising etc.

In a further embodiment according to the invention, the insertion element is for example a sheet metal part. In this situation, the sheet metal part has for example a pin portion for the respective blade element to be formed. The insertion element with its opening can for example be manufactured using a stamping process and/or a precision cutting process, whereby the blade elements can be manufactured for example by shaping or bending. A sheet metal part as the insertion element has the advantage that it is simple and very cost-effective to manufacture.

In a further embodiment according to the invention, a first partial portion of the pin portion has a curved or rounded form and/or an angular form, for example a rectangular or a square form, whereby the first partial portion and optionally additionally a second partial portion of the pin portion can be reshaped in such a manner that a blade element can be manufactured with a curved cross-section or a curved form. The curved or rounded form has the advantage compared with a sharp kink that it is also possible to deflect unfavorable flow angles without substantial pressure losses.

According to a further embodiment according to the invention, at least the rotor housing of the turbocharger is manufactured using the die-casting process or sand-casting process. The die-casting process has the advantage that it is a particularly cost-effective manufacturing process.

In another embodiment according to the invention, an insertion wall element is for example provided on the wall opposite the insertion element or diffuser rear wall. The insertion wall element can for example likewise be a sheet metal part. In this situation, the insertion wall element is for example implemented in such a manner that with the spiral it embodies a rounding in order to avoid a sharp transition of a radial flow into the spiral. In this situation, at least one or more blade elements can optionally additionally be supported on the insertion wall element, for example in the region of the rounding of the insertion wall element. This has the advantage that no additional fixing of the insertion element is required and moreover the gentle deflection of the flow into the spiral can additionally be supported by the insertion wall element in its rounded configuration.

The invention will be described in detail in the following with reference to the exemplary embodiments given in the schematic figures of the drawings. In the drawings:

DESCRIPTION OF THE INVENTION

Figure 1:
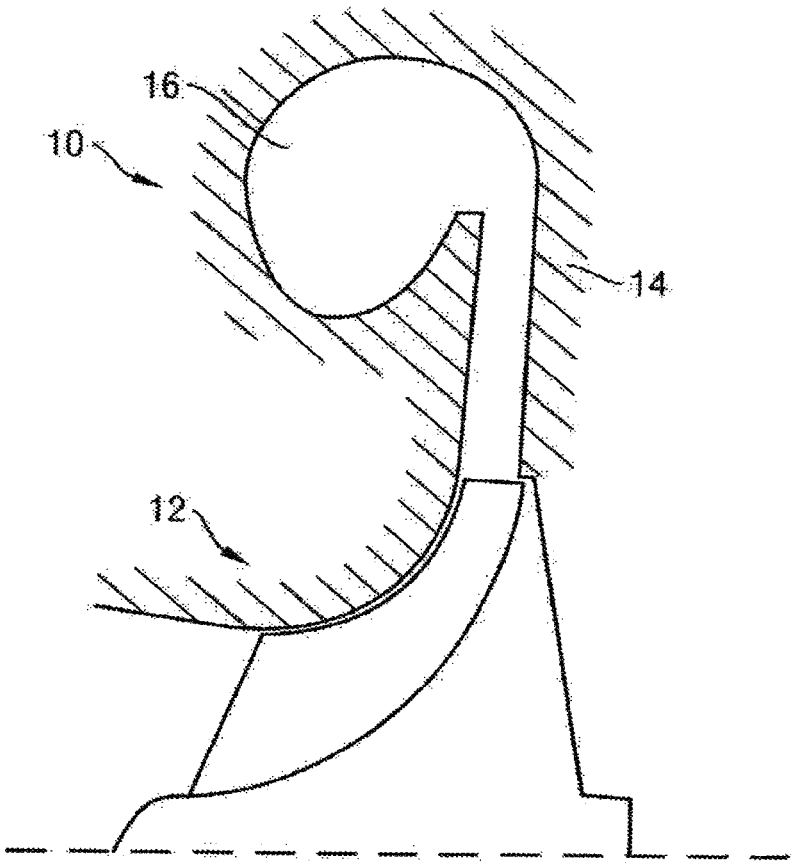
FIG. 1 shows a schematic partial portional view of a compressor having a compressor casing with an overhanging spiral in accordance with the prior art.

The same elements and devices, and elements and devices having the same function, have been identified by the same reference characters in all the figures—unless otherwise stated.

FIG. 1 shows a partial portional view of a compressor 12 of a turbocharger 10. In this situation, the compressor 12 has a compressor casing 14 in accordance with the prior art, which is provided with an overhanging spiral 16. Such an overhanging spiral 16 does however have the disadvantage, as described above, that the compressor casing 14 can only be manufactured using sand-casting with an inserted core which is destroyed following the casting operation. By contrast, it is not possible to manufacture such a compressor casing 14 for example by means of a die-casting process on account of the overhanging spiral 16.

Figure 2:
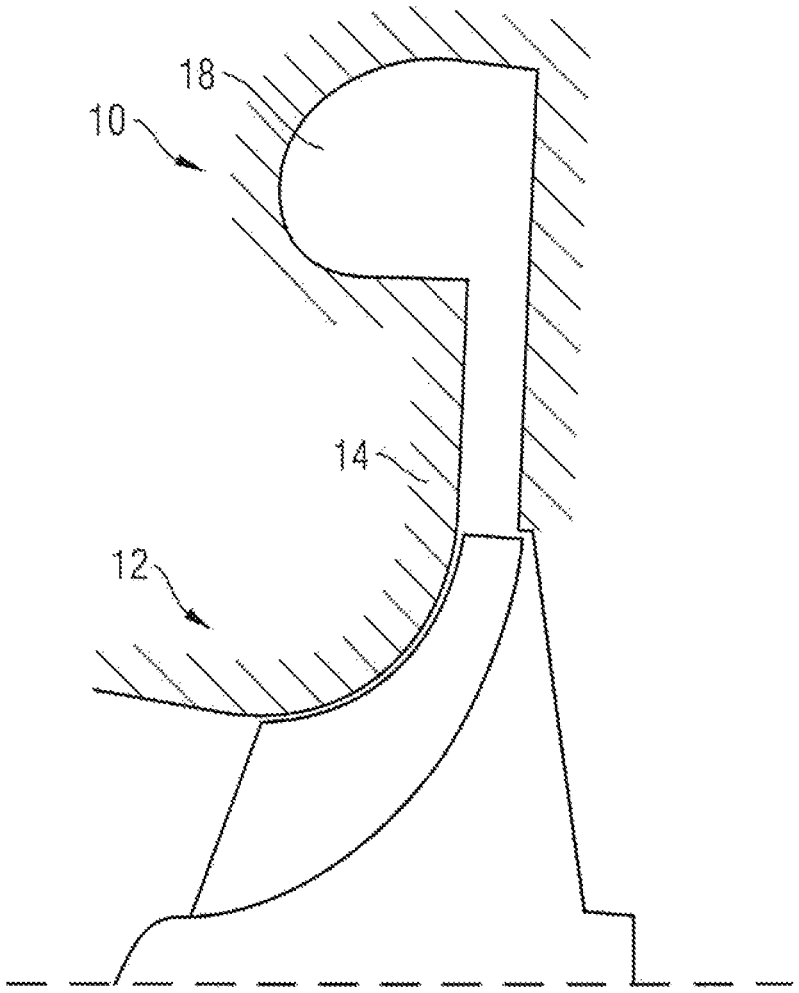
FIG. 2 shows a schematic, simplified partial portional view of a compressor having a compressor casing according to the invention.

FIG. 2 now shows a greatly simplified partial portional view of a compressor 12 having a compressor housing form according to the invention. In this situation, in the first instance the compressor casing 14 has an essentially non-overhanging spiral 18, in contrast to the spiral 16 of the compressor casing 14 according to FIG. 1. In other words, the spiral 18 in FIG. 2 has no depression but the lower wall of the spiral runs essentially straight to the outside, in other words the wall does not form a depression, as does the wall in FIG. 1. The compressor casing 14 according to the invention has the advantage that it can also be manufactured by means of a die-casting process, which is considerably more cost-effective than the sand-casting process. But now in order to create a type of overhanging spiral for such a compressor casing 14 as illustrated in FIG. 2, an insertion element 24 is provided which is described in detail in the following with reference to FIG. 3.

Figure 3:
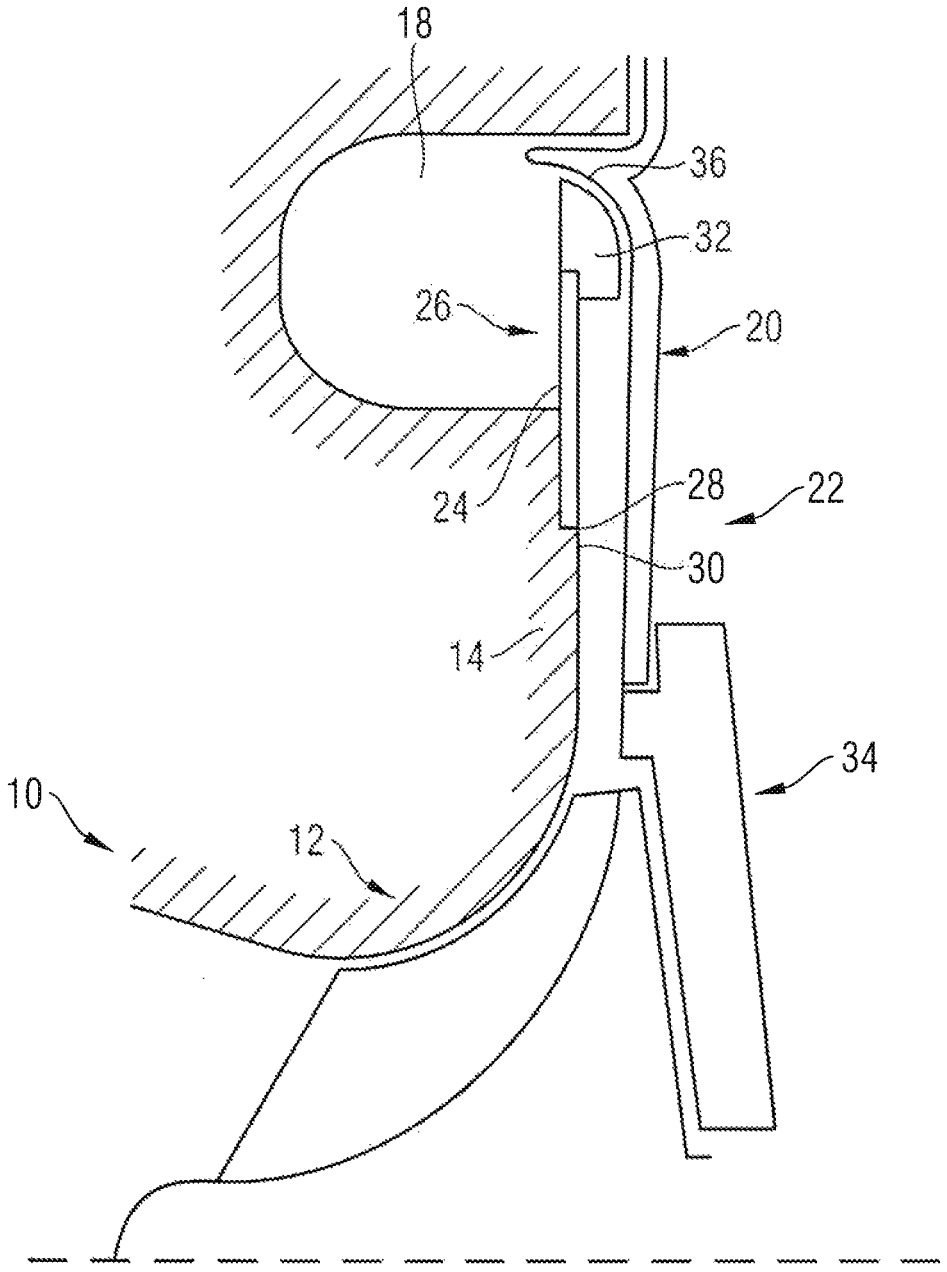
FIG. 3 shows a schematic partial portional view of a compressor having a compressor casing according to the invention, whereby the compressor casing has an insertion plate element.

An embodiment of the turbocharger 10 according to the invention and its compressor casing 14 is now illustrated in FIG. 3. In this situation, the compressor casing 14 has an essentially non-overhanging spiral 18, in other words a spiral 18 without a depression. Furthermore, in the embodiment as is shown in FIG. 3 an insertion wall element 20 is for example provided which forms a part of a diffuser rear wall 22. In principle, the insertion wall element 20 can also essentially form the entire diffuser rear wall 22.

Furthermore, as is shown in FIG. 3, an insertion element 24 made for example from sheet metal is provided which forms the diffuser front wall or diffuser front side 26. The insertion element 24 has for example an opening 28 by means of which it is for example mounted onto a shoulder 30 of the compressor casing 14. Furthermore, the external diameter of the insertion element 24 is chosen such that it preferably projects beyond the lower wall of the spiral and thus with the lower wall forms a depression or implements an overhanging spiral. In this situation, the insertion element 24 can be affixed on the compressor casing, for example by means of screwing, welding, adhesive means, brazing, pinning etc. To this end, it is sufficient if the insertion element 24 is implemented for example as flat disks. In another embodiment according to the invention, in order to affix the insertion element 24 in the compressor casing it can however also be implemented in such a manner that it is supported against the diffuser rear wall 22. In this case, it is possible to dispense with an additional fixing means, as described above, employing screwing, welding etc. The insertion element 24 can essentially be held adequately only by being supported on the compressor casing. To this end, the insertion element 24 can be provided at one, two, three, four or more points with a projection which is bent over such that in the installed state the insertion element 24 is supported against the diffuser rear wall 22. In this situation, the projection can have any desired contour. Furthermore, in the case of a plurality of projections, these can for example essentially be arranged distributed on opposite sides or on the circumference of the insertion element 24, whereby the projections can be implemented either identically or also differently in each case, depending on how or where the support of the insertion element 24 is to be effected.

Moreover, in a further alternative embodiment the insertion element 24 has at its circumference at least one or more blade elements 32, or projections which are implemented in such a manner that they can be bent over to produce blade elements 32. The blade elements 32 are implemented in such a manner that they direct an air-mass flow of the compressor to the spiral. The air-mass flow of the compressor 12 passes firstly in the radial direction and is then directed through the blade elements 32 into the spiral 18. This deflection through the blade elements 32 has the advantage that flow losses occurring in the case of marginal flow angles can be reduced.

Furthermore, the blade elements 32 can be implemented in such a manner that the insertion element 24 can additionally be supported on the rear wall 22 of the diffuser by way of the blade elements 32. This means that it is for example possible to dispense with any additional fixing of the insertion element 24 on the compressor casing 18. In this case it is sufficient if the insertion element 24 is pushed onto the shoulder 30 of the compressor casing 14. Otherwise, the insertion plate or insertion element 24 can optionally be affixed on the compressor casing 14 using established fixing methods or fixing means, for example by means of welding, brazing, pinning and/or screwing, to quote only a few examples.

As is shown in FIG. 3, the blade elements 32 are bent forward in such a manner that they can be supported on the diffuser rear wall 22 or here the insertion wall element 20. In this situation, the insertion wall element 20 is affixed on a part of the turbocharger housing 34 and forms the diffuser rear wall 22 or at least a part of the diffuser rear wall 22.

The invention is not however restricted to this specific embodiment, as shown in FIG. 3. In particular, the insertion wall element 20 can be implemented in any desired manner. In the case as represented in FIG. 3 the insertion wall element 20 is for example implemented slightly rounded or curved with respect to the spiral 18 in order to prevent a sharp kink and thus an unfavorable flow. The respective blade element 32 of the insertion elements 24 is in turn arranged in the rounded region 36 and is supported against the insertion wall element 32. The diffuser rear wall 22 may however have any other form and for example also be implemented without the rounded region 36. Furthermore, instead of an insertion wall element 20 it is also possible for example to provide any other form of diffuser rear wall 22 made of sheet metal.

With regard to the illustration in FIG. 3, a two-part spiral 18 is provided, consisting of a cast housing and a diffuser rear wall comprising an insertion wall element 20. The spiral 18 can however also be implemented in any other manner, or from other parts according to function and intended use.

Figure 4:
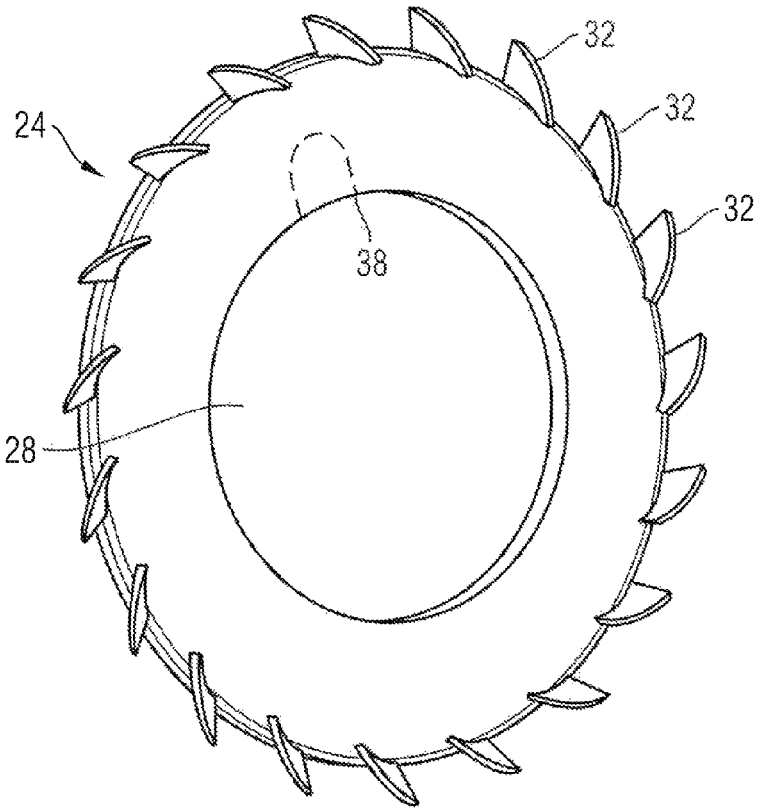
FIG. 4 shows a perspective view of the insertion plate element according to FIG. 3.

FIG. 4 shows a perspective view of the insertion element 24 according to FIG. 3. In this situation, a plurality of blade elements 32 is provided on the circumference of the insertion element 24. In this situation, the blade elements 32 may be identically formed or at least in part differently formed, depending on how the deflection of the air-mass flow is to take place in the compressor 12. Furthermore, in this situation, no blade elements 32, all or only a part of the blade elements 32 can for example additionally be supported on the diffuser wall 22, such that an additional fixing of the insertion element 24 is not necessarily needed.

Furthermore, in addition to the projections which are bent to form blade elements 32 the insertion element 24 can also have at least one other, or two, three or more other projections which can be provided with any desired contour, as described above. This projection or these projections are not bent as blade elements 32 but are only reshaped such that the insertion element 24 is able to be supported in the compressor casing on a wall, here for example a diffuser wall 22 situated opposite. In this case, it is possible that for example none of the blade elements 32 needs to be implemented in such a manner that it can be supported, for example on the diffuser rear wall 22.

In FIG. 3 the insertion element 24 furthermore has for example a round opening 28 by means of which the insertion element 24 is mounted onto a shoulder 30 of the compressor casing 14. The insertion element 24 can however also have any other type of opening 28 in order to be affixed to the compressor casing 14. For example, the compressor casing 14 can have a projection (not shown) which engages in a corresponding recess 38 in the insertion element 24 and in doing so additionally fixes the insertion element 24 in the radial direction. A corresponding recess 38 in the insertion element 24 is indicated in FIG. 4 by a dashed line.

Figure 5:
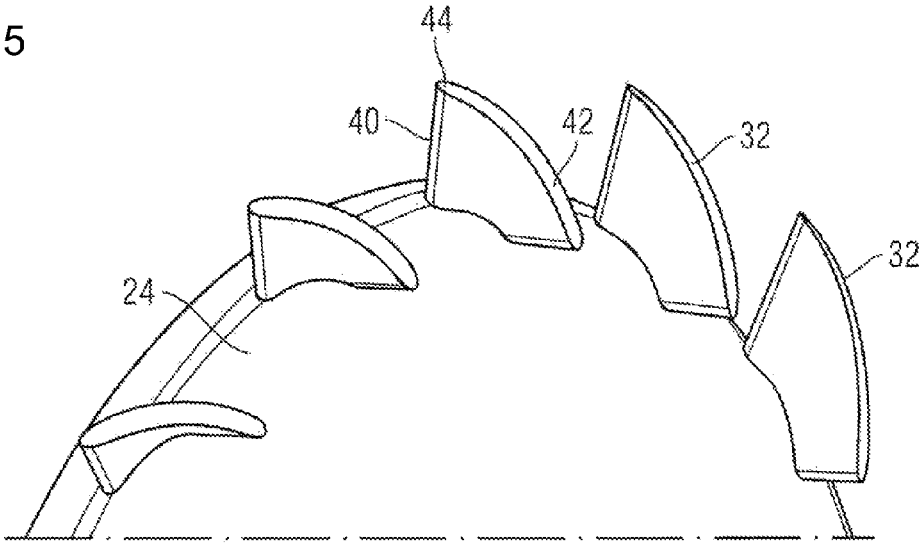
FIG. 5 shows a portion of the insertion plate element according to FIG. 4.

In addition, a portion of the insertion element 24 according to FIG. 4 is shown in FIG. 5. Blade elements 32 of the insertion element 24 which have been bent or formed into shape are illustrated in the perspective view of the portion. In this situation, it can be seen from FIG. 5 that the blade elements 32 do not form a sharp kink but are implemented in an arched or curved fashion in order to deflect the flow for example into an essentially radial flow.

Figure 6:
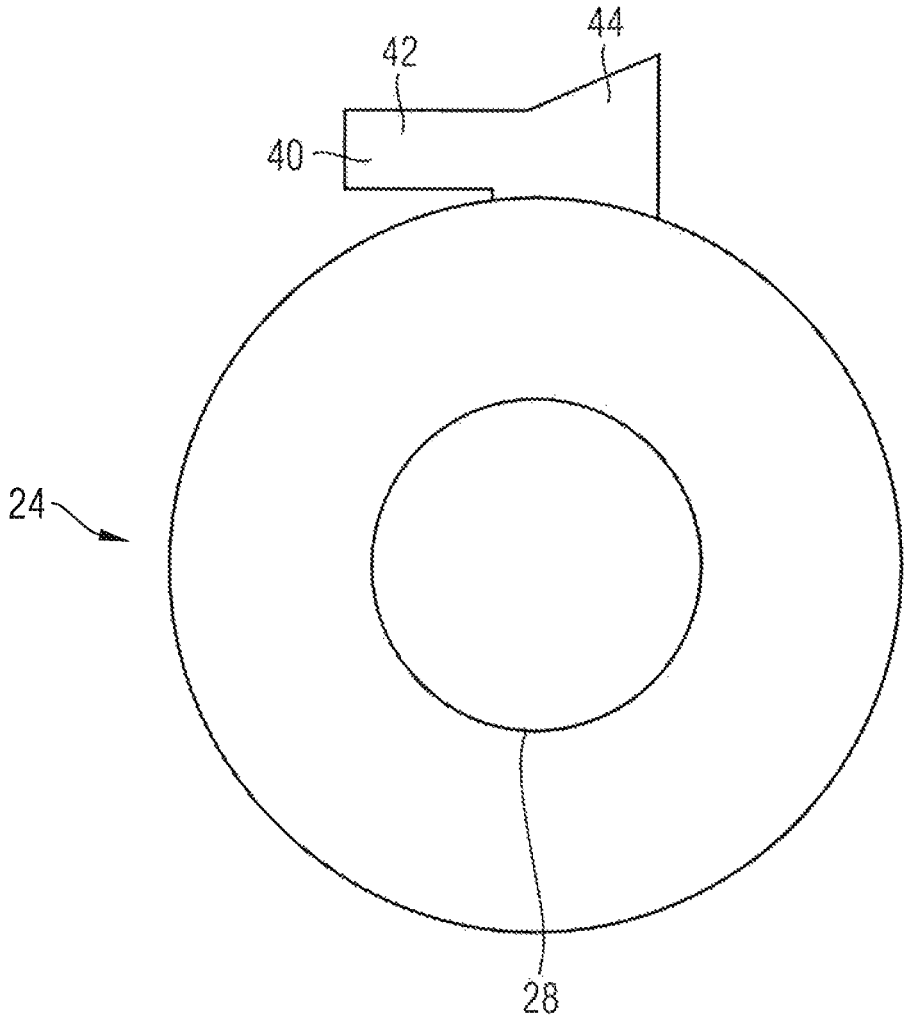
FIG. 6 shows a simplified representation of a sheet metal part for the formation of an insertion plate element according to the invention.

Furthermore, FIG. 6 shows a greatly simplified example of a sheet metal blank or a stamped sheet metal part for forming an insertion element 24 according to the invention.

The example in FIG. 6 shows a round insertion element 24 having a pin portion 40 for forming a blade element 32. The other pin portions for the other blade elements which are arranged on the circumference of the insertion element 24 have not been shown for reasons of clarity in this case.

The pin portion 40 has for example a first partial portion 42, for example an essentially rectangular or square partial portion 42. This first partial portion 42 can for example essentially be bent in a range between 70° and 80° or 70° and 90° or 70° and 100° (including all intermediate values, in particular all integer intermediate values), with the result that a blade element 32 is produced which deflects the flow from the diffuser into the spiral 18. In this situation, the first partial portion 42 forms a curved blade element 32 together with a second partial portion 44. The second partial portion 44 may for example not be bent or be scarcely bent and have a form which together with the first correspondingly curved partial portion 42 forms a curved blade element 32 for appropriately deflecting the air-mass flow of the compressor 12 into the spiral 18 of the compressor casing 14.

This deflection can reduce the flow losses occurring in the case of marginal flow angles and thereby improve the degree of efficiency. In this situation, the number of pin portions 40 corresponds to the number of blade elements 32 or guide vanes resulting. A further function of this guide baffle is to support the insertion element 24 with respect to the diffuser rear wall 22. With this additional function it is possible to dispense with further fixing of the insertion element 24. In this situation, it is sufficient if the guide baffle 32 can be supported on the diffuser rear wall 22 by means of at least one, two, three, more or all guide vanes.

Such an insertion element 24 can be manufactured inexpensively using a stamping process and/or a precision cutting process. The insertion element 24 can subsequently be appropriately reshaped, for example by appropriate bending of the pin portions 40 with respect to the desired blade elements 32. The invention is however not restricted to these manufacturing processes. They serve merely as examples. As described above, instead of or in addition to these blade elements 32 projections can be provided which can have any desired contour and which are merely reshaped such that they can be supported on the diffuser rear wall 22. Such projections which merely constitute support portions and not a blade element 32, as are shown in FIGS. 4 and 5, have the advantage that they can be manufactured in a particularly simple and cost-effective manner. In this situation, the projections can for example be implemented as round, oval and/or angular or have any other contour and dimensioning which is suitable to enable them to be reshaped so as to be supported on a wall.

Furthermore, the compressor casing 14 can be manufactured in the die-casting process. In principle, it can however also be manufactured by means of other processes, such as for example the sand-casting process etc. The die-casting process has the advantage compared with the sand-casting process that the disadvantages regarding installation space and degree of efficiency can be compensated for by a die-cast spiral and a clear cost advantage can be maintained. Apart from a casting process, the compressor casing 14 can for example also be constructed from corresponding, suitable sheet-metal parts, to state a further example.

Through the provision for example of a two-part spiral 18, as shown for example in FIG. 3, it is possible to achieve low costs and moreover to attain a high degree of efficiency.

Although the present invention has been described above with reference to the preferred exemplary embodiments, it is not restricted thereto but can be modified in many different ways.

The present invention can be applied to turbochargers for motor vehicles (passenger cars) and also to any other type of motor vehicle in the broadest sense.

Furthermore, the respective blade element 32 can be implemented or shaped as desired provided that the current of the air-mass flow can be suitably deflected into the spiral 16, 18 of the compressor casing 14. In particular, the first and second partial portions 42, 44 of the pin portion 40 can have any desired shape for forming the blade elements 32 provided that they can be suitably reshaped to produce a blade element 32 which directs the air-mass flow suitably into the spiral 16, 18 of the compressor casing 14. The illustrations of the blade elements 32 and their sheet metal in FIGS. 4, 5 and 6 serve merely as examples and the invention is not restricted thereto.

In principle, an insertion element 24 can, as described above, also be employed in the case a compressor casing having an overhanging spiral 16, as shown for example in FIG. 1.

The invention claimed is:

1. A turbocharger, comprising:

a compressor casing;

an insertion element; and a diffuser rear wall located opposite said insertion element;

said insertion element being configured to form an overhanging spiral with said compressor casing;

said insertion element being sheet metal and having a circumference with a plurality of projections formed by reshaping to produce a plurality of support portions supporting said insertion element on said diffuser rear wall.

2. The turbocharger according to claim 1, wherein at least one of said plurality of support portions is formed as a blade element for deflecting a flow.

3. The turbocharger according to claim 1, wherein said insertion element is configured to direct or deflect an air-mass flow from a compressor wheel into said overhanging spiral of said compressor casing.

4. The turbocharger according to claim 1, wherein said compressor casing is formed with a shoulder, and said insertion element is disposed on said shoulder.

5. The turbocharger according to claim 1, wherein said compressor casing is formed with a shoulder having a projection, said insertion element is formed with an opening, and said opening has a recess which engages in said projection of said shoulder of said compressor casing in order to additionally fix said insertion element in a radial direction.

6. The turbocharger according to claim 1, wherein at least one of said plurality of support portions is formed as a blade element.

7. The turbocharger according to claim 6, wherein said one, several, or all of said blade elements are configured to be supported on an opposite wall.

8. The turbocharger according to claim 7, wherein said opposite wall is said diffuser rear wall.

9. The turbocharger according to claim 1, wherein said insertion element is additionally secured by a process selected from the group consisting of welding, brazing, screwing, and mortising.

10. The turbocharger according to claim 1, wherein said insertion element is a sheet metal part manufactured using at least one of a stamping process or a precision cutting process, and wherein said plurality of projections are formed by reshaping or bending to produce said plurality of support portions.

11. The turbocharger according to claim 1, further comprising an insertion wall element being a sheet metal part forming a rounding with said spiral, said insertion wall element forming said diffuser rear wall.

12. The turbocharger according to claim 11, wherein said insertion wall element is additionally supported by at least one of said plurality of support portions at said insertion wall element.

* * * * *